US005465974A

United States Patent [19]

Adise

[11] Patent Number: 5,465,974

[45] Date of Patent: Nov. 14, 1995

[54] METHOD OF DEALING PLAYING CARDS

[76] Inventor: Herbert H. Adise, 65 Dickenson Pl., Great Neck, N.Y. 11023

[21] Appl. No.: 303,324

[22] Filed: Sep. 9, 1994

[51] Int. Cl.[6] ..... A63F 1/00

[52] U.S. Cl. ..... 273/292

[58] Field of Search ..... 273/292, 274

[56] References Cited

PUBLICATIONS

Scarne's Encyclopedia of Games, John Scarne, Harper & Row, Publishers, 1973, pp. 278–285.

Scarne's *New* Complete Guide to Gambling, John Scarne, Simon and Schuster, New York, 1961, 1974, pp. 356–358, 366–382.

Scarne's Guide to Casino Gambling, John Scarne, Simon and Schuster, New York, 1978, pp. 76–81, 84–93.

Beat The Dealer, Edward O. Thorp, Random House, New York, 1962, 1966, pp. 8–11, 18–29, 38, 39, 44–53, 74–78, 93–113, 188–195.

The Mathematics of Gambling, Edward O. Thorp, Lyle Stuart, Secacus, 1984, pp. 4–17.

Blackjack Your Way To Riches, Richard Albert Caufield, Carol Publishing Group, New York, 1977, pp. 28, 29, 36–41, 108–113, 120, 121, 126, 127.

Progression in Blackjack, Donald Dahl, Carol Publishing group, New York, 1993, pp. 3–5, 9–11.

Turning The Tables On Las Vegas, Ian Andersen, The Vanguard Press, New York, 1976, pp. 5–21.

The Winner's Guide To Casino Gambling, Edwin Silberstang, Holt, Rinehart and Winston, New York, 1980, pp. 63–69, 80–98.

The New American Guide To Gambling And Games, Edwin Silberstang, New American Library, New York, 1972, 1979, 1987, pp. 285–301.

The Theory of Blackjack, Peter A. Griffin, Huntington Press, Las Vegas, 1979, 1981, 1986, 1988, pp. 12–25, 31.

The Theory Of Gambling And Statistical Logic, Richard A. Epstein Academic Press Inc., San Diego, 1977, pp. 218–221, 226–237, 244, 245.

*Primary Examiner*—Benjamin H. Layno

[57] ABSTRACT

A method of dealing playing cards in the gambling casino game known as Twenty-one or Blackjack which prevents player skill from determining the outcome of a game. The method involves the removal of a multiplicity of unseen cards from the active deck before each game, creating large uncertainties in the deck's composition which nullify the mathematical probabilities upon which player strategy is based and which make card counting impossible, thereby removing the means by which the players gain advantage over the dealer. The uncertainties grow large with each game dealt from a deck, enabling dealers to play the active deck down completely without giving undue advantage to players.

11 Claims, 3 Drawing Sheets

METHOD OF DEALING PLAYING CARDS

BACKGROUND

1. Field of Invention

This invention relates to the gambling casino card game of Twenty-One, also known as Blackjack, specifically to a method of dealing the cards to eliminate player skill from the game.

2. Description of Prior Art

It is common knowledge that the card game of Twenty-One, also known as Blackjack, is unique among all casino gambling games because the casino's winning "edge" is not fixed, as it is in other games such as Craps or Roulette, but varies with each play of a card, so that the player's chances of winning fluctuate significantly from one game to the next. Since the rules of play allow the player to make a series of decisions which directly affect the outcome of the hand, a skillful player can adjust his betting and play to take the most advantage of favorable situations while risking the least in unfavorable ones.

The two main factors that determine the player's chances of winning the hand is what cards are left in the deck at the start of that hand and how the hand is played. Both of these depend upon the player's knowledge of the composition of the deck from which that game is dealt. As certain cards are removed from the deck during prior game play and dealing, the player's chances of being dealt various combinations from the remaining cards increases or decreases, sometimes giving the casino an advantage over the player and sometimes giving the player an advantage over the casino. If the player places large wagers when his chances of winning are greater and small wagers when his chances of winning are lower, in the long run the player will come out ahead. Knowing the chances of winning before each hand is dealt, at the time the wager is placed, depends upon the player keeping track of the cards as they are dealt by means of some card-counting system.

Knowledge of the composition of the deck is not only a guide to wagering, but is vital to successful game play. Edward Thorp, a university mathematics professor, was the first to use an advanced electronic computer to mathematically determine the best possible play for any situation a player may face, based upon the player's initial two-card holding, the value of the dealer's one face-up card, and the known composition of the full deck. He formulated these optimal playing decisions into a simple set of rules he called the "Basic Strategy". For examples: When the player holds a 16 or less and the dealer shows a 7, the dealer's probability of drawing to a 17–21 is 0.74 (where 0=never happens and 1.00=always happens), meaning that nearly ¾ of the time the player will lose by standing on his holding. Therefore, when the dealer shows a 7 and the player holds 16 or less, the player should draw to try to improve his holding. But if the player's 16 is made up of two 8's, the player should "split" the pair since the probability of the player drawing to 17–21 when holding an 8 is 0.76, and he is therefore more likely to beat the dealer by drawing separately to each 8 rather than to the 16 total; or if the player holds an 11 and the dealer shows a 7, the player shouls "double down" since the probability of reaching 17–21 with a one-card draw to an 11 is 0.79 and he is therefore more likely to beat the dealer who shows a 7. Similarly, when the dealer shows an Ace and the player holds a 20 made up of two 10's (a very likely winner if the dealer doesn't have a 21), the probability of winning the Insurance bet is 0.29—where the Insurance pays 2 to 1, in 100 games the player will receive 58 bet units for his likely 29 wins and lose 71 bet units, giving the casino a 13% advantage! Therefore the player must not insure a 20. But if he holds two low cards, say an 8 and a 6, the probability of his winning the Insurance bet is 0.33, giving the casino only about a 1% advantage; if the player is playing two hands and elects to stand on a 17 in the second hand which is made up of a 9 and an 8, then the probability of the Insurance win becomes 0.34, giving the player a 2% advantage! The Insurance wager is now advantageous!.

Where in a single-deck game with standard rules of play, the casino enjoys an overall advantage over players of about 6%, a player using the Basic Strategy can gain a net advantage of about 1% over the casino, which can increase to over 15% (or even 100%) when the deck is favorable (as revealed by "card-counting").

The standard method of dealing makes it easy for the player to know the composition of the deck with near exactness and so can confidently use the Basic Strategy: first, the dealer shuffles the full deck, then he completes the cut of the deck where a player has indicated, after which the player removes the top card from the deck and typically sets it aside to start a discard pile (called "burning" a card). After each player has placed his wager, the dealer deals out the game in the normal way. All cards used in the game are eventually exposed before the dealer deposits them face-down on the discard pile, setting the stage for the deal of the next game in which the remainder of the deck will be used. Typically, after several games have been played but before the deck is exhausted, the remainder deck is added to the discard pile (restoring the deck to wholeness), and now using the entire discard pile, the dealer will start the next cycle of shuffling, cutting and "burning" before dealing out the next succession of games. In fact, at any time the dealer wishes he may reshuffle all the cards for the next round of games.

FIG. 1 schematically shows the flow of cards in the prior-art dealing method. Of particular significance is the fact that with this method of dealing the players know the composition of the active deck in advance of placing a bet or playing the game.

Through extensive analysis on the computer, Thorp had discovered that the percentage of 10's against other cards measured the degree of favorability—a full single deck contains 36 no-10's and 16 10's, a ratio of 2.25 to 1, and when through card play that ratio became less than 2,25 to 1, the remainder deck was proportionately "richer" in 10's and therefor more favorable to the player. This measurement required that the player keep a double count: first, before the used cards are scooped up by the dealer and placed on the discard pile, the player must count how many 10's and other cards have been played in the first round and second, the player must subtract these from the 36-to-16 ratio with which the deck began; this process must be repeated for each game.

Of course, the "count" was most advantageous to the player if the remainder deck was played down to the very last card so that the player not only knew the ratio (the degree of favorability for betting) but also knew exactly what cards remain in the deck and therefore knew exactly how to play his hand.

Thorp published his findings, which become a best-selling book. This book inflamed the avaraice of gamblers avery-where since it told exactly how to surely "beat the dealer". The operating principle was easy to understand. Basic Strategy was most valid for the first hand dealt from the shuffled deck. As cards were dealt, the deck's composition was altered and so were the probabilities on which sound play tactics depended. Therefore it was important to keep track of the changing character of the deck by noticing which cards were dealt and, by subtraction from the number of those known to previously exist in the deck, know which cards remain to be dealt. As the deck dwindled, more than modifying the decisions of play, Thorp modified the size of his bets. When the deck was "rich" in high-cards (favorable to the player but likely to force the dealer to "bust" and therefore lose), Thorp multiplied his bets.

When Thorp showed that it was possible to win at Twenty-One by using Basic Strategy and card counting, an increasing number of players began to win in the casinos. The casinos' initial panicky response was to alter the rules of play so as to deny players certain advantageous play options. This gross tactic discouraged all players and, when the consequent erosion of business became apparent, casinos restored the rules and elected to substitute other tactics: first, the deck would no longer be played completely (so that players would not have the advantage of "counting down the deck"), i.e., all cards would be reshuffled together well before the active deck was exhausted (or whenever the dealer wished, as shown in FIG. 1), and second, multiple decks were substituted for the single deck formerly used, both to make "counting" more burdensome and consequently less attractive to all but the most dedicated players, and to provide the casino with a greater advantage (a four-deck game added 0.54% to the casino's "edge"). Even though players knew from Thorp's work that the single-deck game was most favorable, the small advantage gained by the casino with multi-deck games did not discourage game play. Enterprising player/mathematicians simply devised other methods of card-counting which were more suited to handling multi-deck games than Thorp's complicated system, and equally effective.

In a later edition of his book, Thorp endorsed a method called "simple point-count" which, with certain variations is still in use. In this method, low cards (2,3,4,5,6) are counted as "+1" as each card is seen to fall during game play and high cards (10,A) are counted as "−1" as each is seen to fall; the intermediate cards (7,8,9) are counted as "0". A running cumulative count of the exposed cards is maintained. With full decks, the count starts and ends at 0. For examples: if 5,5,3,8 are seen to fall, the running cumulative count is +3, and if A,10,10,9,8,8,10,A,A are seen to fall, the running cumulative count would be −6. The cumulative count measures the high-card "richness" in the remainder deck—when it is a high plus number, the remainder deck is "rich" in high cards (favoring the player) and when it is a high minus number, the remainder deck is "rich" in low cards (favoring the dealer). Thorp recommended that the player bet 1 unit if the point-count total is zero or minus,and if the point-count is plus, bet as many units as the point-count total. Thorp also recommended certain changes in his Basic Strategy such as only when the cumulative point-count is greater then +8 should the player take "Insurance" (normally a poor bet with a full deck); when the deck shows a cumulative point-count of −6 or greater minus (there are many small cards in the deck), and the dealer shows a 7 or more, the player should restrict doubling to an 11 holding only, and not split Aces but draw (with a full deck, doubling down on 9 or 10 is recommended, particularly if the dealer shows 2 through 6, and Aces should always be split).

In response to continued player wins despite early shuffles and multi-deck use, the casinos resorted to the additional tactic of barring recognized "card counters", a practise which continues. None of these tactics can totally defeat skilled "card counters" because so long as the standard method of dealing, shown in FIG. 1, is used, players would know the total composition of the active deck(s) in advance of the deal and during game play with a high degree of certainty; they would be able to wager and exercise the various play options so as to maximize wins and minimize losses. While casinos can change the rules of play to benefit themselves (at the risk of discouraging game play and loss of profits), they have not yet come up with an economically-viable way to encourage Twenty-One game play while eliminating the player skill factor from determining the outcome of the game.

OBJECTS AND ADVANTAGES

Accordingly, several objects and advantages of the present invention are:

(a) to eliminate player skill as a determinant of the outcome of the casino gambling card game of Twenty-One;

(b) to prevent players from deducing the composition of the active deck used in the casino gambling card game of Twenty-one;

(c) to eliminate Basic Strategy and card counting as reliable guides to player game play and betting in the casino gambling card game of Twenty-One;

(d) to provide a casino profit-enhancing method of dealing cards in the gambling game of Twenty-One which does not require any special equipment or special dealer skills;

(e) to provide a casino profit-enhancing method of dealing cards in the gambling game of Twenty-One which stimulates player participation;

(f) to eliminate the necessity of casinos to closely monitor players of the gambling card game of Twenty-One in order to detect and bar "card counters";

(g) to extend the number of games played between deck shuffles by enabling complete dealing of the deck without giving added advantage to the players of the gambling casino card game of Twenty-One.

Further objects and advantages of my invention will become apparent from a consideration of the ensuing decription and drawings.

DRAWING FIGURES

REFERENCES IN DRAWINGS

Figure 1:
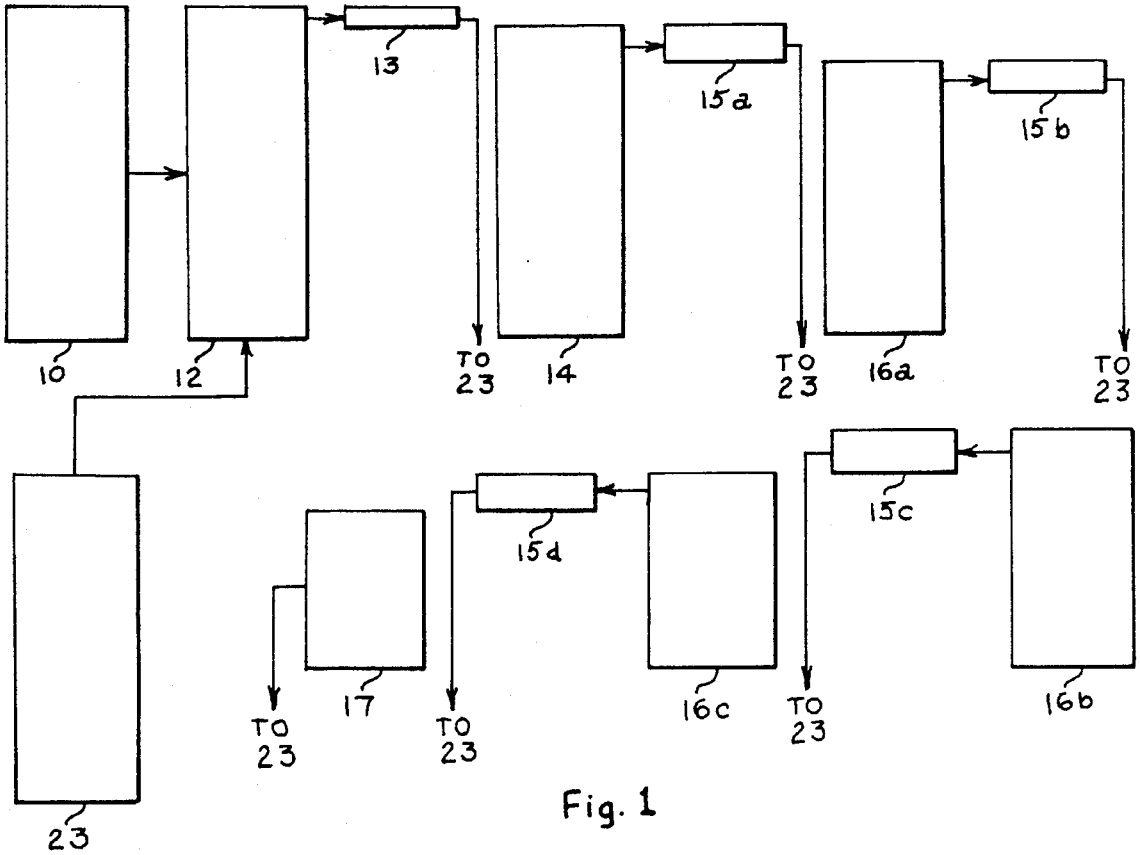
FIG. 1 is a schematic diagram of the flow of cards in the prior-art method of dealing.

| Symbols | |
|---|---|
| | Dealer shuffles and completes player-designated cut. |
| ⟶ | Dealer deals cards |

-continued

| Symbols | |
|---|---|
| --> | Dealer discards cards |
| | Active deck(s) with known card composition |
| | Active deck(s) with unknown card composition |
| | Exposed discards |
| | Unexposed discards |
| | Discard pile |

Numbers

10 Single or multiple standard card deck(s)

12 Shuffled and cut active deck(s)

13 Single card discard ("burn" card)

14 Active deck(s) before deal of a round of game play

15 Cards exposed during a round of game play

16 Remainder of active Deck(s) after a round of game play

17 Remainder of active deck(s) after last game

23 Discard pile before shuffle and cut

24 Multiple-card discard

Figure 2:
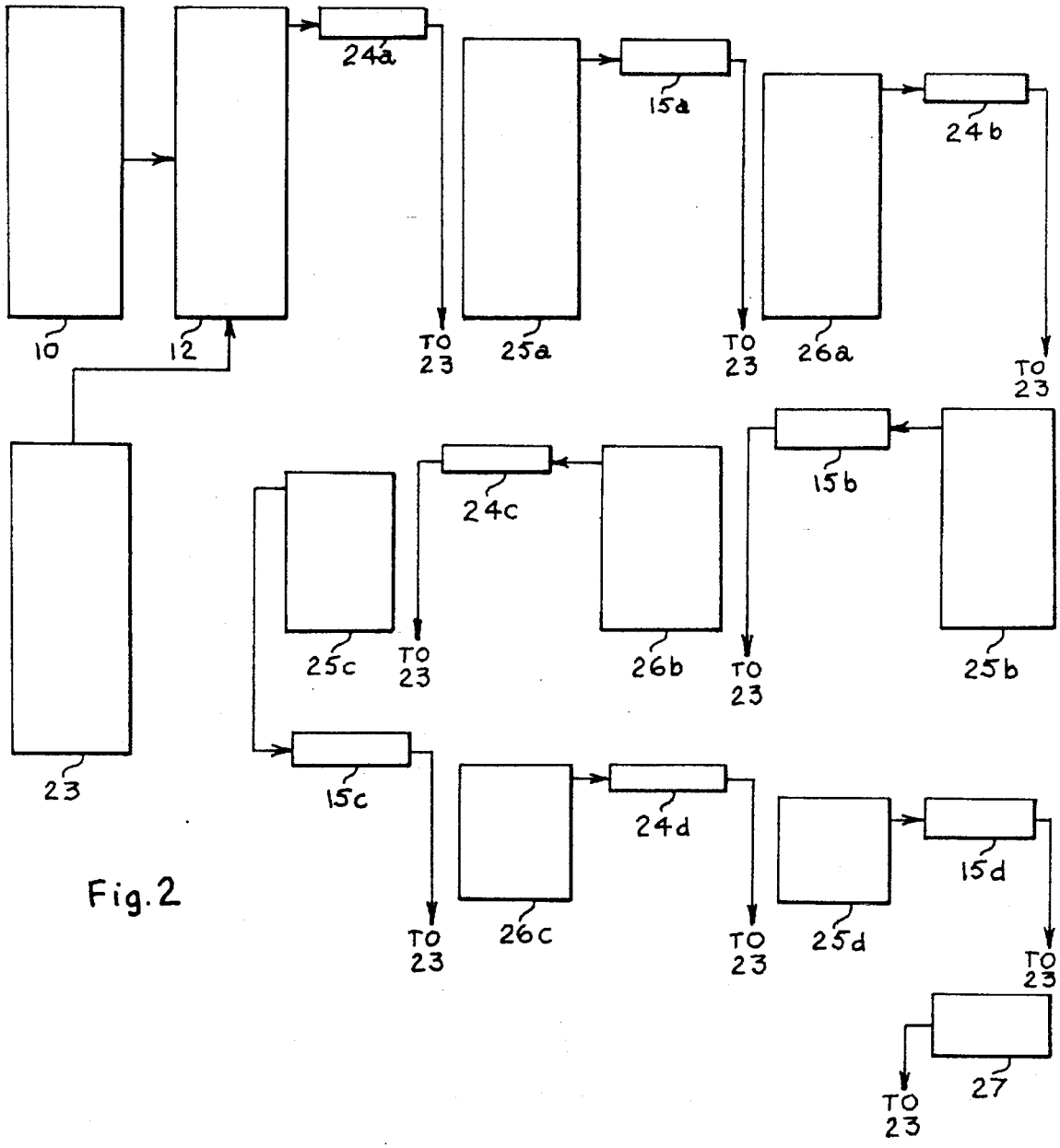
FIG. 2 is a schematic diagram of the flow of cards in one embodiment of the present invention.
Figure 3:
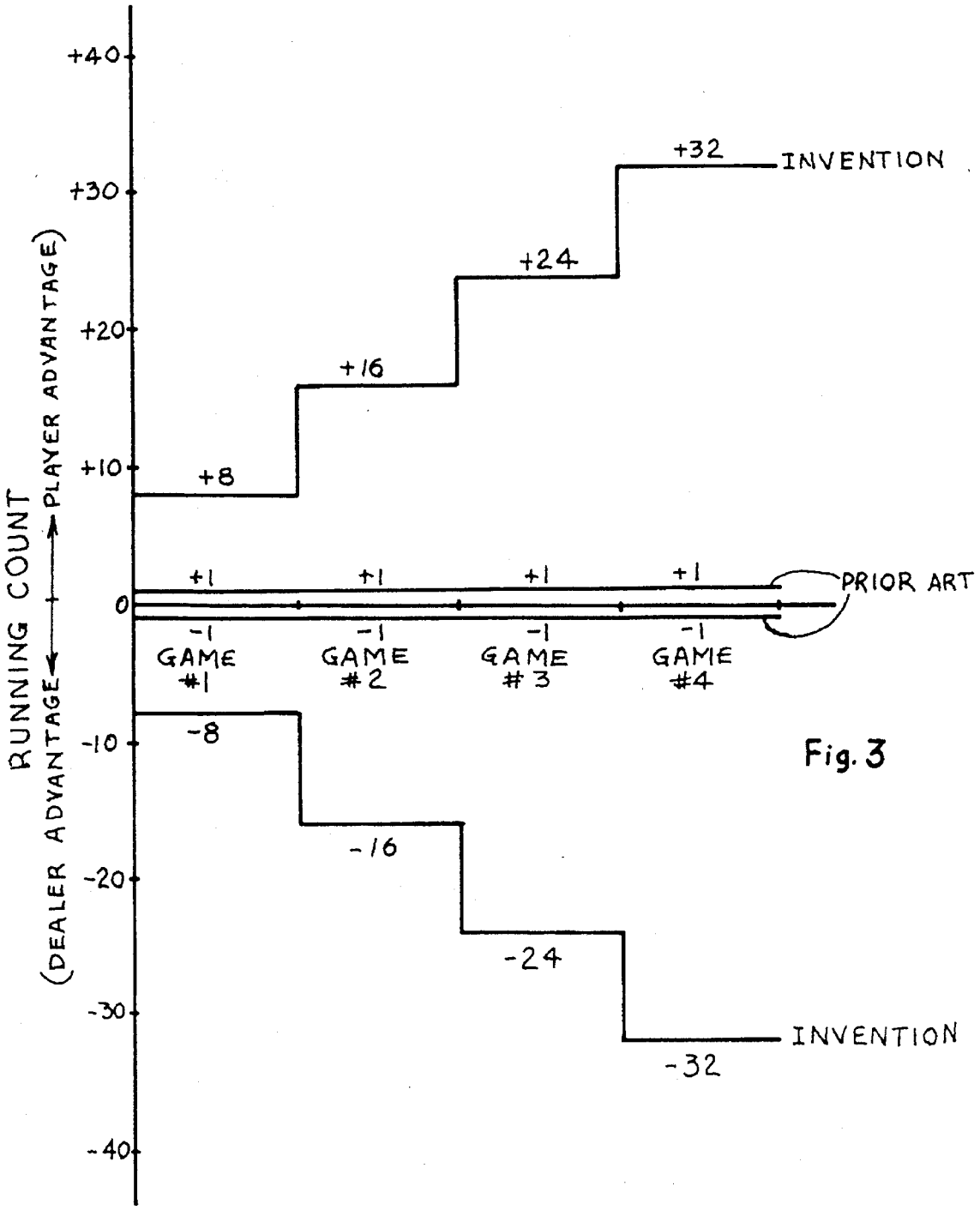
FIG. 3 is a graphical representation of the maximum possible variability in the cumulative point-count of the deck produced by the embodiment of the present invention shown in FIG. 2 and the prior-art method of dealing shown in FIG. 1

Description—FIGS. 1 to 3

In FIG. 1, starting with a single standard card deck or multiple standard decks of playing cards 10, the dealer shuffles all the cards and completes the cut of the shuffled deck at a point designated by a player, to produce a shuffled and cut active deck(s) 12; the dealer then removes one card 13 from 12 and places it unseen face-down to start a discard pile 23, leaving a remainder active deck(s) 14. Cards 15 are dealt out and exposed during game play, after which the dealer places them face-down on 23. The remainder active deck(s) after game play 16 is used for each succeeding round of game play involving cards 15, which are placed on 23 after use. When the remainder active deck 17 is reduced in size to the number of cards decided upon by the dealer, the dealer adds 17 to 23 which, after shuffling and cutting, becomes the new active deck(s) 12.

In FIG. 2, starting with a single standard deck or multiple standard decks of playing cards 10, the dealer shuffles all the cards and completes the cut of the shuffled deck at a point designated by a player, to produce a shuffled and cut active deck(s) 12; the dealer then removes a multiplicity of cards 24 from 12 and places them face-down to start a discard pile 23, leaving a remainder active deck(s) 14. Cards 15 are dealt out and exposed during game play, after which they are placed face-down on 23. The remainder active deck(s) after game play 16 is the active deck(s) from which the dealer removes again cards 24 (placing them on 23), and uses the remainder active deck(s) 14 to deal cards 15 for the next round of game play (these cards are also placed on 23 after being exposed during the game). This procedure of discarding a multiplicity of cards from the active deck(s) before each game is dealt is repeated until the remainder active deck(s) 17 is reduced in size to the amount of cards decided upon by the dealer, at which point the dealer adds 17 to 23 which, after shuffling and cutting, becomes the new active deck(s) 12.

In FIG. 3 the plus number indicates player favorability and the minus number indicates dealer favorability. The number itself is calculated on the basis of the cumulative number of cards discarded before each game; the plus number is the result of assuming all discards (unseen) are of low value and the minus number is the result of assuming that all unseen discards are high-value cards. In the case of the prior-art method of dealing (FIG. 1) the running count is based on a single card 13 removal from the deck(s) only before the first game, and in the present invention method of dealing (FIG. 2) the running counts are based on eight-card discards 24 before each game.

Operation—FIG. 1 vs FIG. 2

In the present invention (FIG. 2), typically 8 cards 24 are discarded in a two-deck game and 4 cards 24 are discarded in a single-deck game. So, for examples, in the prior-art method of dealing where only one card is discarded before the first game even when using two decks, the maximum possible variation in the running count is ±1 for all games whereas for the present invention the maximum possible variation in the running count is ±8 in the first game and grows to ±32 in the fourth game.

As previously explained, the running count is a measurement of the composition of the remainder deck(s). Any variation in this count is a measure of the degree of uncertainty in the composition of the remainder deck(s). The maximum possible variation in the running count created by the prior-art method of dealing is very low (±1), affecting in a material way neither the player's game play advantage when using the Basic Strategy or the recommended player's betting decisions. By comparison, the maximum possible variation in the running count produced by the present invention method of dealing is large before the first game and grows much larger with each succeeding game. Reflecting uncertainty in the composition of the remainder deck(s), these large variations in the running count directly impact on the Basic Strategy and wagering. The various card-counting and Basic Strategy methods rely on an exact knowledge of the composition of the deck(s) before a game is played—how many cards of each value are in the remainder deck(s) so that as cards fall the remaining number can be determined by subtraction; these numbers are essential to card counting and for deriving the Basic Strategy. Uncertainty in the composition makes card counting impossible and the Basic Strategy invalid. The player has no sure way of knowing how to play or bet advantageously— he cannot tell when the deck(s) is favorable or unfavorable. In short, the method of dealing which is the present invention negates any and all player advantages offered by the Basic Strategy and card counting. Since the uncertainty grows rapidly with each game played from the same deck(s), the deck(s) can be played to exhaustion with no fear by the casino that the skilled player will know how to bet and play for maximum advantage in the last game.

This feature of the present invention enables the casino to restore the use of a single 52-card deck which is played completely (certain to draw players since all players know that this is the most advantageous arrangement for them—at least according to Thorp and other experts), while at the same time introducing enough uncertainty in the deck so as to negate player skill as a factor in determining the outcome of a game. In fact, the following method of dealing with one deck should greatly stimulate casino play of Twenty-One while at the same time restore the casino's expected winning "edge": the dealer deals out two cards to each player in the normal way but they can be face-up, further promoting the eagerness of players to participate by suggesting even greater player favorability by aiding "counting"—but, in fact, giving the player no added advantage; the dealer also deals three pairs of face-down cards to himself. Like in signalling the deck's cut-point, a player is asked to select which one of the three pairs the dealer must play; alternatively, each dealer pair may be placed on a numbered spot on the table and the player may be asked to roll a die where the number thrown indicates which one of the three pairs the dealer is to play. The dealer then places the two unselected pairs (4 cards in all) face-down on the discard pile before turning the top card on the selected pair face-up. The game is then played in the normal manner with the dealer playing his selected pair and the remainder deck being used for drawing additional cards if necessary. For the next games, each time the game is dealt, the dealer will repeat the process of dealing himself three pairs of cards then discarding the two unselected pairs before playing the selected pair. In effect, before each game 4 unseen cards will be removed from the deck, thereby creating an uncertainty in the deck's composition which increases with each game. The Basic Strategy and the card count will be totally invalidated as guides to betting and game play.

For example, the running count for the first game will have an automatic uncertainty of ±4; this means that if the first card that falls in game play is a 10-value card (normally indicating a running count of −1) the actual count may be anywhere from −5 (if the 4 discards happen to be 10's or Aces) to +3 (if the 4 discards happen to be all low-value cards), signalling that the remainder deck is either unfavorable or favorable to the player—which it is the player can only guess—as he must do to decide on the size of his bet and the play of his cards. The running count has an uncertainty in the second game of ±8 (the remainder deck is either more favorable or more unfavorable or maybe neutral) and again, the player has no reliable guide to wagering or playing. The remainder deck for the third game has a running count uncertainty of ±12 (indicating even more uncertainty in the remainder deck so that the player can again only guess how much to bet or how to play the third game). If after the third game (or after any later game) the number of cards remaining in the deck is less than required to complete the next game, these may either be added to the discard pile to be reshuffled, cut and then dealt out to players in the next games, or they may be dealt out as far as they can with the discard pile (after shuffling and cutting) used as the new deck to continue the dealing out of the next games. If fewer cards are used in each game, more games will be played before running out of cards in the deck, but in any event, the deck can be played down to the last card.

SUMMARY, RAMIFICATIONS, AND SCOPE

Thus, by using the present invention, even with a single deck played to exhaustion, a casino is assured that pure chance alone, not player skill, will determine the outcome of its Twenty-One games and that it will therefore be assured of its expected 6% (or more) winning "edge".

Additionally, the use of the present invention does not burden the casino with the requirement for any special equipment or special dealer training, and does not reduce playing time as compared with the prior art; in fact, being able to play the deck(s) down to exhaustion without penalty will actually extend the time of game play between shuffles while at the same time stimulate participation by players who have been led by earlier experience, or expert opinion, to believe that they will enjoy an added advantage when the deck(s) is played down completely.

Also, since the present invention negates any player advantage gained through card counting, the casino no longer needs to closely monitor players for possible barring (to protect its profits) and therefore the casino can now dispense with the entire personnel and other apparatus now in use for this purpose, not only reducing casino costs but also avoiding offending innocent players who may have been barred by overzealous casino guardians.

Although the above description contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

I claim:

1. A method for dealing playing cards in a twenty-one game comprising the steps of:

a) dealing out two cards to each player and the dealer from a stack of said playing cards in accordance with normal rules, and b) removing a plurality of playing cards face down from the remaining cards in the stack after step (a), before dealing out each and every round of game play, and placing the removed face down playing cards out of play, and c) dealing out the cards from the stack of cards: remaining after step (b) for each and every round of game play of said twenty-one game in accordance with the normal rules, whereby players are effectively prevented from deducing the composition of the stack during game play and gaining advantage thereby.

2. The method of claim 1 wherein said stack of cards is comprised of at least one 52-card deck.

3. The method of claim 1 wherein said stack of cards is shuffled and cut before step (A).

4. A method for dealing playing cards in a twenty-one game comprising the steps of:

a) dealing out two cards to each player in accordance with the normal rules and dealing out a multiplicity of two-card hands face down to the dealer from a stack of said playing cards, and b) removing all but one of said dealer's two-card hands dealt out in step (a) face down, before dealing out cards for each and every round of game play in accordance with the normal rules, placing the removed face down playing cards out of play, and c) dealing out the cards from the stack remaining after step (a) For each and every round of play of said twenty-one game in accordance with the normal rules, whereby players are effectively prevented from deducing the composition of the stack during game play and gaining advantage thereby.

5. The method of claim 4 wherein said stack of cards is shuffled before step (a).

6. The method of claim 4 wherein said stack of cards is shuffled and cut before step (a).

7. The method of claim 4 wherein said stack of playing cards is comprised of at least one 52-card deck.

8. A method for dealing playing cards in a twenty-one game comprising the steps of:

a) removing more than three said playing cards face down from a stack of playing cards when dealing out each and every round of game play, and placing the removed face down playing cards out of play, and b) dealing out cards from the stack remaining after step (a) for the play of each and every round of said twenty-one game in accordance with the normal rules, whereby players are effectively prevented from deducing the composition of the stack during game play and gaining advantage thereby.

9. The method of claim 8 wherein said stack of playing cards is comprised of at least one 52-card deck.

10. The method of claim 8 wherein said stack of playing cards is shuffled before step (a).

11. The method of claim 8 wherein said stack of playing cards is shuffled and cut before step (a).

* * * * *